United States Patent [19]

Iimura et al.

[11] Patent Number: 4,623,603

[45] Date of Patent: Nov. 18, 1986

[54] SPHERICAL ELECTROPHOTOGRAPHIC MAGNETOPLUMBITE-TYPE HEXAGONAL FERRITE CARRIER POWDER

[75] Inventors: Tsutomu Iimura, Tachikawa; Minoru Chinju, Kumagaya, both of Japan

[73] Assignee: Hitachi Metals, Ltd., Tokyo, Japan

[21] Appl. No.: 744,906

[22] Filed: Jun. 17, 1985

Related U.S. Application Data

[63] Continuation of Ser. No. 482,547, Apr. 6, 1983, abandoned.

[30] Foreign Application Priority Data

Apr. 7, 1982 [JP] Japan ..... 57-57752

[51] Int. Cl.[4] ..... G03G 9/14

[52] U.S. Cl. ..... 430/108; 423/594; 430/106.6

[58] Field of Search ..... 430/108, 106.6

[56] References Cited

U.S. PATENT DOCUMENTS

| | | | |
|---|---|---|---|
| 3,839,029 | 10/1974 | Berg | 430/106.6 X |
| 3,901,695 | 8/1975 | Shelffo | 430/107 X |
| 3,929,657 | 12/1975 | Jones | 430/106.6 |
| 4,124,735 | 11/1978 | O'ltore | 430/108 |
| 4,126,454 | 11/1978 | Jones | 430/108 X |

FOREIGN PATENT DOCUMENTS

| | | | |
|---|---|---|---|
| 0177160 | 10/1982 | Japan | 430/108 |

OTHER PUBLICATIONS

Standley, Oxide Magnetic Materials, Oxford Press. pp. 131–141.

*Primary Examiner*—J. David Welsh

*Attorney, Agent, or Firm*—Finnegan, Henderson, Farabow, Garrett & Dunner

[57] ABSTRACT

An electrophotographic ferrite carrier with substantially spherical shape based on a magnetoplumbite structure of hexagonal ferrite or ferroxplana structure derived from the magnetoplumbite structure has a high electrical resistivity and a longer life.

16 Claims, 3 Drawing Figures

SPHERICAL ELECTROPHOTOGRAPHIC MAGNETOPLUMBITE-TYPE HEXAGONAL FERRITE CARRIER POWDER

This is a continuation of application Ser. No. 482,547, filed Apr. 6, 1983, abandoned.

BACKGROUND OF THE INVENTION

The present invention relates to an electrophotographic developer, and more particularly to an improvement in a ferrite carrier as a toner carrier in the two-component developer.

A cascade development method and a magnetic brush development method are known as methods for electrophotographic development where the so called one-component developer and two-component developer are used as developers. The toner carrier of the so called two-component developer requires an appropriate triboelectric property to attract toner particles, particles that are high enough in density and strength to withstand breakup and are high in flowability, uniform particle size, a constant surface state stable in humidity various other conditions high tensile strength high, compression strength, etc., and appropriate magnetic properties such as saturation magnetization, permeability, coercive force, etc.

Various materials have been used for the toner carrier, and now iron powder is most widely used. Iron powder carrier is used generally after an appropriate surface treatment, but the surfaces of iron powder particles undergo physical or chemical change when it is used for a long time, and consequently toners remain on the carrier surfaces or the carrier becomes so sensitive to the humidity of the surrounding atmosphere as to lose good image quality. Thus, the life of carrier is shortened. These are disadvantages of iron powder carrier.

Ferrite has been proposed as a toner carrier having such disadvantages of iron powder carrier (e.g. U.S. Pat. No. 3,929,657). However, known electrophotographic ferrite carriers are mainly the so called spinel type ferrite, which have not always been found satisfactory with respect to image characteristics or life according to the results of copy-testing the ferrite of such type prepared by the present inventors as a ferrite carrier, and a better toner carrier has been still in demand.

The present invention has been established to meet such demand.

SUMMARY OF THE INVENTION

The object of the present invention is to provide an electrophotographic toner carrier of novel structure with better image characteristics and longer life, and the object can be attained by using as a toner carrier a substantially spherical electrophotographic ferrite carrier which comprises a single phase structure of magnetoplumbite type hexagonal ferrite represented by the general formula $MeFe_{12}O_{19}$, where Me is Ba, Sr, Pb, Ca, etc., where a portion of Me is substituted with at least one species of monovalent, divalent and higher valence metals, or a double phase structure of the magnetoplumbite type hexagonal ferrite and a spinel type ferrite, or a single phase structure of ferroxplana type ferrite derived from the said hexagonal $MeFe_{12}O_{19}$ ferrite, such as Z type ($Ba_3Me'_2Fe_{24}O_{41}$), Y type ($Ba_2Me'_2Fe_{12}O_{22}$), W type ($BaMe'_2Fe_{16}O_{27}$) or X type ($Ba_2Me'_2Fe_{28}O_{46}$), where at least one of Ba and Me are substituted with at least one substituent of monovalent, divalent and higher valence metals represented by Me', or a double phase structure of the ferroxplana type ferrite and a spinel type ferrite, and having an electric resistivity of at least $10^3$ Ω-cm, a saturation magnetization of at least 10 emu/g and an average particle size of 20–1,000 μm.

As described above, it is known to use ferrite as a toner carrier. For example, a ferrite carrier is disclosed in said U.S. Pat. No. 3,929,657 as "humidity insensitive, uncoated electrostatographic carrier materials comprising substantially stoichiometric ferrite compositions within about ±3 mol percent deviation from stoichiometry in divalent metal content", and further according to said U.S. Patent "the ferrite materials of main interest in the electrostatographic arts are the soft ferrites; the soft ferrites may further be characterized as being magnetic, polycrystalline, high resistive ceramic materials exemplified by intimate mixtures of nickel, manganese, magnesium, zinc, iron, or other suitable metal oxides with iron oxide" (column 2, lines 54–60), and specifically only Ni-Zn ferrite, Mn-Zn ferrite, etc. having the so-called stoichiometric compositions represented by $MFe_2O_4$ are disclosed therein.

Having found that the properties of the said well known ferrite carrier are not always satisfactory, the present inventors have established the present invention as a result of various experimental studies of magnetoplumbite type hexagonal ferrite known to have good performance as a permanent magnet and good economy, and also of W type, Z type, Y type and X type ferrites derived from the magnetoplumbite ferrite on the basis of quite a different technical concept.

The ferrite carrier according to the present invention has an electric resistivity ranging from $10^4$ to $10^{12}$ Ω-cm. In this range, the triboelectricity can be readily controlled to an appropriate value, and the ferrite is hardly susceptible to an influence of humidity, etc., with the result that the desired clear image can be readily obtained. The present ferrite carrier has a saturation magnetization of at least 10 emu/g. Below 10 emu/g, the attractive force to a magnetic roll becomes low and the desired clear image is hard to obtain. The present ferrite carrier has a coercive force of not more than 100 Oe. When the coercive force of the ferrite exceeds 100 Oe, the ferrite particles themselves have properties as a magnet and are very liable to stick to various parts, with the result that it is hard to obtain a good image. The present ferrite carrier has a permeability μ of at least 10. When the permeability μ is less than 10, reaction to a magnetic roll is deteriorated to give an adverse effect to an image. The present ferrite carrier has a Curie temperature Tc of at least 50° C. and the particles of the present ferrite carrier have a strength of at least 1,000 g/cm$^2$.

In the present invenion, the composition range of ferrite carrier for better image characteristics is variable, but better results can be obtained in the following range. That is, MeO as BaO, SrO, PbO, CaO, etc. is present in an amount of 5–30% by mole, $Fe_2O_3$ is present in an amount of 50–90% by mole, and Me'O comprising at least one substituent of monovalent, divalent and higher valence metals as Me' is in an amount of less than 40%, preferably 5–40% by mole. If the content of monovalent, divalent and higher valence metals exceeds 40% by mole in the matrix composition, the crystal structure mainly takes a spinel type, and the effect of the present invention that contamination of carrier with toners can be prevented by inclusion of Ba or Sr cannot be obtained. In that case the humidity-resistant properties are also deteriorated, and the largest advantage of the present invention, longer life as a ferrite carrier, will be lost, with the result that an image of good resolution cannot be obtained.

The present ferrite carrier of a single phase structure of magnetoplumbite type or ferroxplana type in a crystallographical sense, has a somewhat lower saturation magnetization than that of a double phase structure of magnetoplumbite type or ferroxplana type and spinel type, but can undergo no contamination with toners or no change in humidity-resistant property, so far as the magnetic force of the roll or developing condition is slightly changed when used, and no life characteristics of the image is changed.

Particle surfaces of the present ferrite carrier can be oxidized or reduced or coated with resin, etc.

The present invention will be described below in detail, referring to Examples and Drawings.

PREFERRED EMBODIMENT OF THE INVENTION

Example 1

20% by mole of BaO, 20% by mole of ZnO and 60% by mole of $Fe_2O_3$ were weighed out and mixed in a mixer. A ball mill, vibrating mill, etc. may be used as the mixer. The mixture was calcined at 800°-1,200° C. The calcined product was pulverized in a pulverizer. A ball mill, vibrating mill, attriter, etc. may be used as the pulverizer. The particle sizes of the resulting powder were 0.3-2.0 μm on average according to the air permeation method. Then, the powder was granulated with an aqueous 0.05-5.0 wt.% polyvinyl alcohol solution as a binder by means of a granulator. A spray drier, kneader, mixer, etc. may be used as the granulator.

The resulting particles were fired at 1,100°-1,400° C. It was possible to place the particles into a container made from alumina, etc. for firing, but in the case of firing a large amount of particles in a container, the particles might grow by bonding one to another. Thus, in this example, the particles were fired while being rotated in a rotary kiln, etc. From an assay of the resulting particles, it was found that the particles had the substantially desired composition.

Electrical resistivity of the thus obtained ferrite particles was determined by a two-probe method, and also the saturation magnetization, coercive force and initial permeability of the ferrite particles were determined in a magnetic field of 10,000 Oe by a vibrating magnetometer. The thus obtained values are shown in Table 1 together with other properties. For comparison, Ni-Zn ferrite and iron powder were prepared and their properties were determined at the same time. The properties of the Ni-Zn ferrite are also shown in Table 1 for comparison.

TABLE 1

| Properties | Species: Ni—Zn ferrite | Species: Ba—Zn ferrite |
|---|---|---|
| Saturation magnetization (emu/g) | 58 | 57 |
| Coercive force (Oe) | 2 | 20 |
| Curie temperature (°C.) | 130 | 425 |
| Electric resistivity (Ω-cm) | 10 | 10 |
| Apparent density (g/cm$^3$) | 2.2 | 2.2 |
| Form | Spherical | Spherical |

Figure 1:
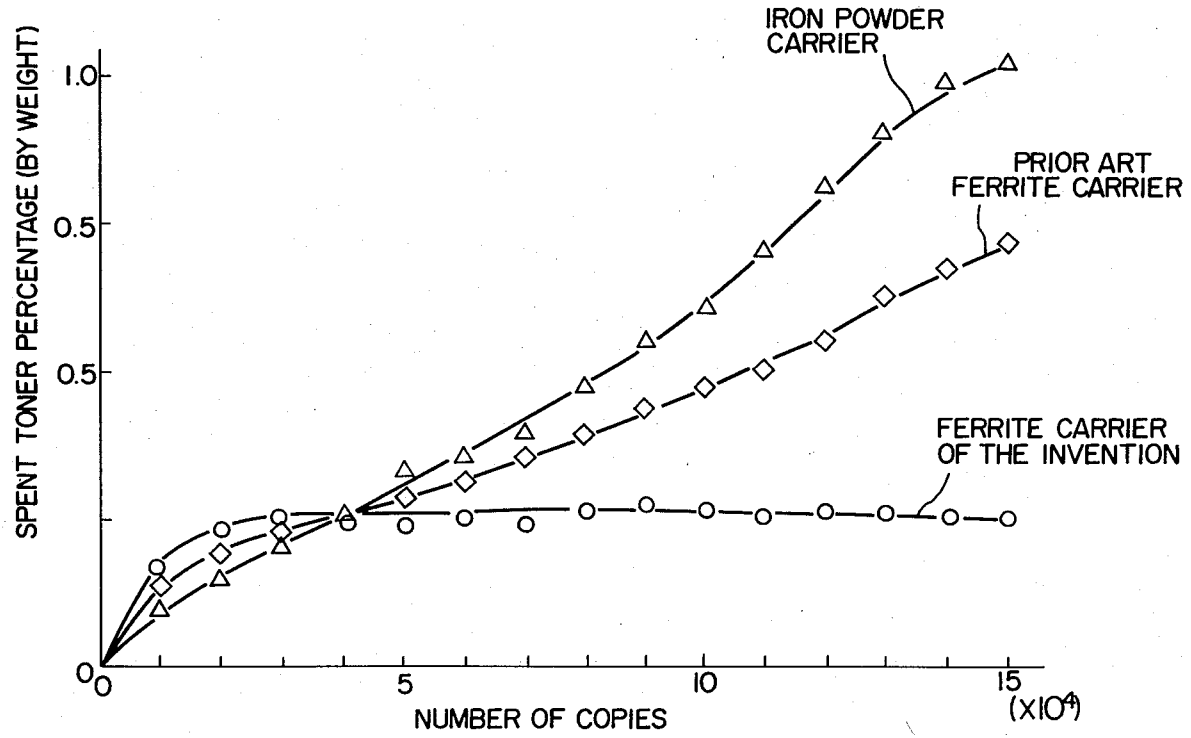
FIG. 1 is a diagram showing the relationship between number of copies and spent toner percentage of conventional iron powder, conventional Ni-Zn ferrite and the present ferrite as toner carriers.

Then, the resin-uncoated spherical ferrite carrier having an average particle size of 100 μm according to the present invention was admixed with toners at a toner concentration of 3% by weight to prepare a developer. On the other hand, the iron powder carrier and Ni-Zn carrier having an average particle size of 100 μm each were likewise admixed with toners at a toner concentration of 3% by weight to prepare developer for comparison. The developers were then subjected to electrophotographic copying under such developing conditions as a magnetic field of 900 Oe for a magnetic roll, a sleeve-drum distance of 1.00 mm and a doctor gap of 1.0 mm with selenium as a photosensitizer. The results are shown in Table 2 and FIG. 1.

TABLE 2

| | Iron powder carrier | Ni—Zn Carrier | Ba—Zn carrier |
|---|---|---|---|
| Spent toner percentage (wt. %) | 1.0 | 0.7 | 0.2 |
| Triboelectricity (μc/g) | −10 | −20 | −20 |
| Electric resistivity (Ω-cm) | $10^6$ | $10^{12}$ | $10^9$ |
| Crystal system | Cubic | Cubic | hexagonal |

The conventional electrophotographic iron powder and Ni-Zn ferrite carrier had a larger spent toner percentage than the present Ba-Zn ferrite carrier, and it is obvious that the surfaces of the conventional carriers were more readily contaminated and coated with toners. The contamination of the conventional carriers was about 4 times larger for the iron powder carrier and about 3 times larger for the conventional ferrite carrier than the present ferrite carrier. It was found that the conventional carriers were not always satisfactory with respect to the image characteristic or life owing to the spent toner. The reason has not be fully clarified yet, but it seems that the conventional iron powder carrier and Ni-Zn ferrite carrier are in a cubic system, and the main crystal faces (100), (110) and (111) are liable to react to toners, whereas the present ferrite carrier is in a hexagonal system and the main crystal faces (1000), etc. are hard to react to toners. Thus, it seems that the differences in composition and crystal system differentiate the reactivity of the carrier surfaces to toners.

Figure 2:
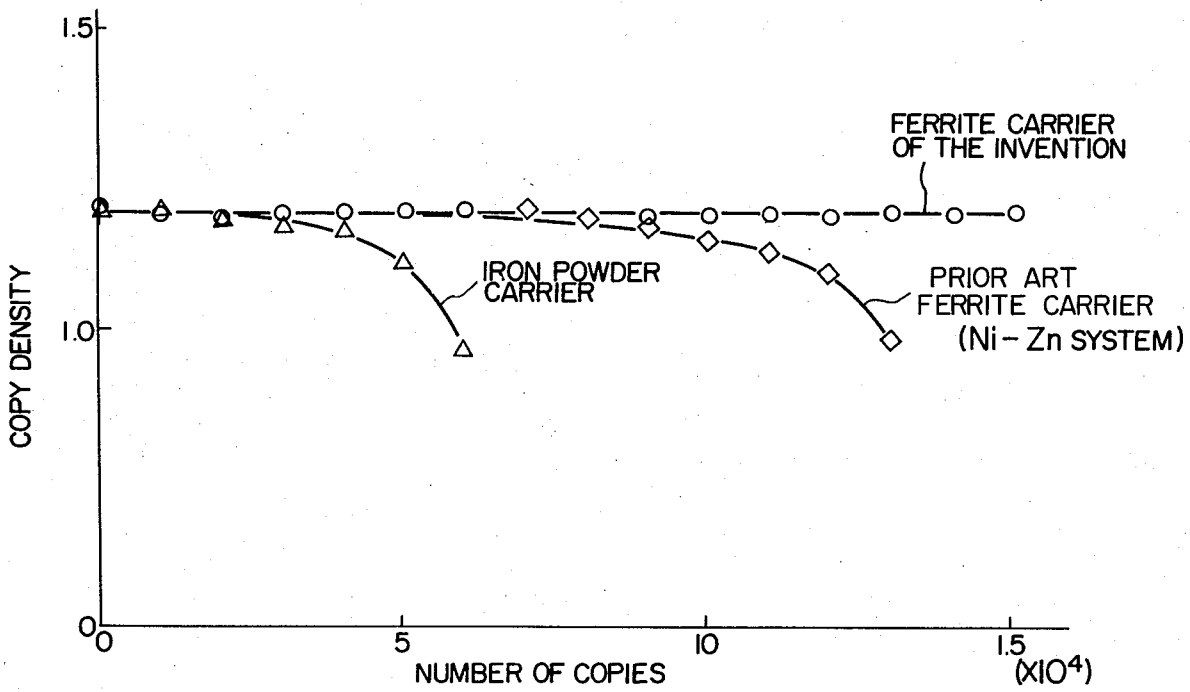
FIG. 2 is a diagram showing the relationship between number of copies and change in copy density of the same carrier materials as in FIG. 1.

As shown in FIG. 2, the copy image density is lowered to less than half of the initial density at about 30,000 copies in the case of the conventional iron powder carrier, and the copy image density was gradually lowered at about 100,000 copies in the case of the conventional ferrite carrier, thus, the conventional ferrite carrier had a life of about 100,000 copies, whereas in the case of the present ferrite carrier the copy image density could be maintained at about 1.3 even after 150,000 copies and clear copies could still be produced.

Figure 3:
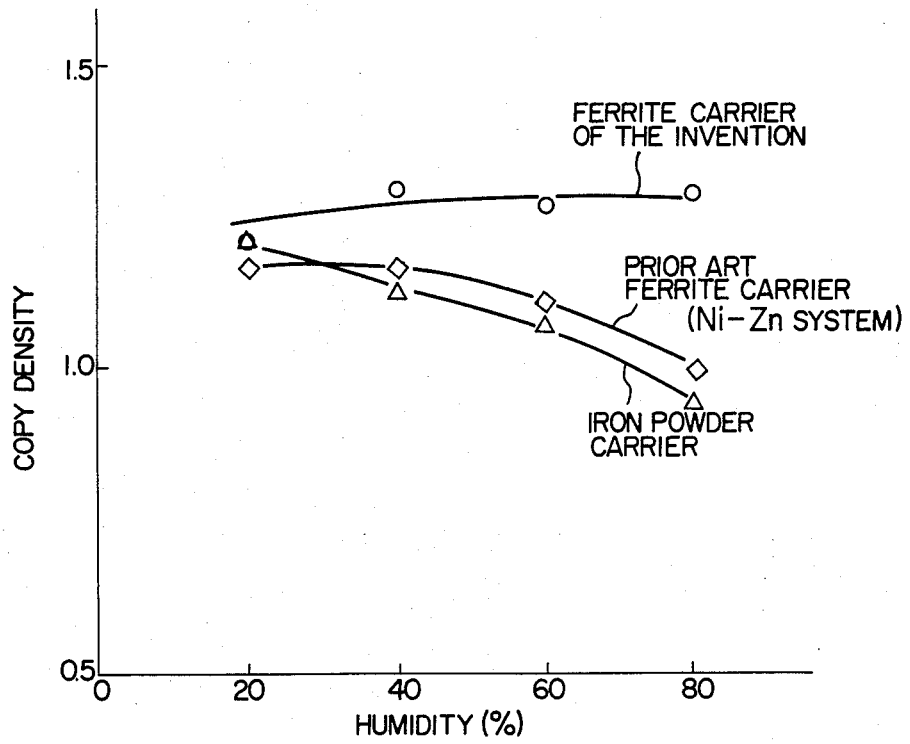
FIG. 3 is a diagram showing the relationship between change in humidity and number of copies.

In FIG. 3, the results of humidity-resistant tests of the present ferrite carrier, the conventional iron powder carrier and the conventional ferrite carrier are shown.

As is obvious from FIG. 3, the present ferrite carrier had no lowering in copy image density even at a temperature of 20° C. and a relative humidity of 80%, and had a good image quality with a high copy image density. It seems that the reason that the present ferrite carrier has less change in copy image density against elevated temperature and elevated relative humidity is differences in crystal system and composition from the conventional iron powder carrier and the conventional Ni-Zn ferrite carrier, and consequently in wettability with toners.

Example 2

20% by mole of SrO, 20% by mole of ZnO and 60% by mole of $Fe_2O_3$ were weighed out and treated in the same manner as in Example 1. The resulting spherical ferrite had substantially same characteristics as those in Example 1. The thus prepared spherical ferrite was subjected to copying tests as a ferrite carrier, and it was found that the thus prepared ferrite carrier had equivalent copying effects to those shown in Example 1.

Example 3

10% by mole of BaO, 5% by mole of NiO, 20% by mole of ZnO, and 65% by mole of $Fe_2O_3$ were weighed out and treated in the same manner as in Example 1. The resulting spherical ferrite had substantially same characteristics as those in Example 1. The thus prepared spherical ferrite was subjected to copying tests as a ferrite carrier, and it was found that the thus prepared ferrite carrier had equivalent copying effects to those shown in Example 1.

Example 4

10% by mole of BaO, 3% by mole of NiO, 2% by mole of $Li_2O$, 20% by mole of ZnO, and 65% by mole of $Fe_2O_3$ were weighed out and treated in the same manner as in Example 1. The resulting spherical ferrite had substantially same characteristics as those in Example 1. The thus prepared spherical ferrite was subjected to copying tests as a ferrite carrier, and it was found that the thus prepared ferrite carrier had equivalent copying effects to those shown in Example 1.

Example 5

18% by mole of BaO, 12% by mole of CoO, and 70.0% by mole of $Fe_2O_3$ were weighed out and treated in the same manner as in Example 1, and the resulting spherical ferrite had substantially same characteristics as those in Example 1. The thus prepared spherical ferrite was subjected to copying tests as a ferrite carrier, and it was found that the thus prepared ferrite carrier had equivalent copying effects to those shown in Example 1.

Example 6

10% by mole of BaO, 5% by mole of NiO, 15% by mole of ZnO, and 70% by mole of $Fe_2O_3$ were weighed out and treated in the same manner as in Example 1. The resulting spherical ferrite had substantially same characteristics as those in Example 1. The thus prepared spherical ferrite was subjected to copying tests as a ferrite carrier, and it was found that the thus prepared ferrite carrier had equivalent copying effects to those shown in Example 1.

As described above, the present ferrite carrier has a higher electrical resistance and longer life than the conventional iron powder carrier and the conventional ferrite carrier and has distinguished effects as an electrophotographic developer material.

Thus, the present ferrite carrier has significant industrial applications.

What is claimed is:

1. An article of manufacture for use as an electrophotographic ferrite carrier, the article comprising a hexagonal ferrite material in particulate form, the material being represented by the general formula $MeFe_{12}O_{19}$, wherein Me is selected from the group consisting of Ba, Sr, Pb and Ca and a portion of Me is substituted with at least one metal, said particles having an electrical resistivity of at least $10^3$ Ω-cm, a saturation magnetization of at least 10 emu/g and a average particle size of about 20–1,000 μm.

2. The article according to claim 1, having a coercive force of not more than 100 Oe.

3. The article according to claim 1 having a permeability μ of at least 10.

4. The article according to claim 1, having a Curie temperature Tc of at least 50° C.

5. The article according to claim 1, wherein the particles of the ferrite carrier have a strength of at least 1,000 g/cm$^2$.

6. The article according to claim 1, wherein the particle surfaces are oxidized or reduced.

7. The article according to claim 1, wherein the particle surfaces are coated with resin.

8. An article of manufacture for use as an electrophotographic ferrite carrier, the article comprising a magnetoplumbite-like structure of hexagonal ferrite, the material in particulate form and being represented by the general formula $MeFe_{12}O_{19}$, wherein Me is selected from the group consisting of Ba, Sr, Pb, and Ca and a portion of Me is substituted to obtain a ferroxplana structure derived from said $MeFe_{12}O_{19}$ hexagonal ferrite, said ferroxplana structure being selected from the group consisting of Z type ($Ba_3Me'_2Fe_{24}O_{41}$), Y type ($Ba_2Me'Fe_{12}O_{22}$), W type ($BaMe'_2Fe_{16}O_{27}$), or X type ($Ba_2Me'_2Fe_{28}O_{46}$), where a portion of Ba and Me is substituted with at least one metal represented by Me', said particles having a substantially spherical shape, an electrical resistivity of at least $10^3$ Ω-cm, a saturation magnetization of at least 10 emu/g and an average particle size of 20–1,000 μm.

9. The article of claim 8, wherein MeO is selected from the group consisting of BaO, SrO, PbO and CaO and is present in an amount from 5–30% by mole, and wherein Me'O comprising at least one metal as Me' is present in an amount from 5–40% by mole and $Fe_2O_3$ is present in an amount from 50–90% by mole.

10. The article as in claim 1 having a coercive force between about 10 Oe and about 100 Oe.

11. In the method of developing electrophotographic images employing a developer having a magnetic carrier component, the improvement comprising the step of using as the carrier a ferrite material in particulate form, and being represented by the formula $(MeO)\alpha(Me'O)\beta(Fe_2O_3)\gamma$ wherein MeO is selected from the group consisting essentially of BaO, SrO, and a mixture thereof; wherein Me'O is selected from the group consisting essentially of NiO, ZnO, MnO, and mixtures thereof; and wherein $\alpha,\beta,\gamma$ are mole percentages ranging, respectively, from about 5 to 30, about 5 to 40, and about 50 to 90, with $\alpha+\beta+\gamma$ being equal to 100.

12. The improved method as in claim 11 wherein the ferrite material used has a coercive force of not more than about 100 Oe.

13. A two-component developer for use in developing electrophotographic images, the developer comprising an admixture of:

(a) a toner component; and (b) a carrier component, wherein said carrier component further comprises a hexagonal ferrite material in particulate form, the material being represented by the general formula $MeFe_{12}O_{19}$, wherein Me is selected from the group consisting of Ba, Sr, Pb and Ca and a portion of Me is substituted with at least one metal, said particles having an electrical resistivity of at least $10^3$ Ω-cm, a saturation magnetization of at least 10 emu/g and an average particle size of about 20–1,000 μm.

14. A two-component developer for use in developing electrophotographic images, the developer comprising an admixture of:

(a) a toner component; and (b) a carrier component, wherein said carrier component further comprises a magnetoplumbite-like structure of hexagonal ferrite, the material in particulate form and being represented by the general formula $MeFe_{12}O_{19}$, wherein Me is selected from the group consisting of Ba, Sr, Pb, and Ca and a portion of Me is substituted to obtain a ferroxplana structure derived from said $MeFe_{12}O_{19}$ hexagonal ferrite, said ferroxplana structure being selected from the group consisting of Z type ($Ba_3Me'_2Fe_{24}O_{41}$), Y type ($Ba_2Me'Fe_{12}O_{22}$), W type ($BaMe'_2Fe_{16}O_{27}$), or X type ($Ba_2Me'_2Fe_{28}O_{46}$), where a portion of Ba and Me is substituted with at least one metal represented by Me', said particles having a substantially spherical shape, an electrical resistivity of at least $10^3$ Ω-cm, a saturation magnetization of at least 10 emu/g and an average particle size of 20–1,000 μm.

15. The developer as in claim 13 wherein the amount of said toner component in said admixture is about 3 wt%.

16. The developer as in claim 14 wherein the amount of said toner component in said admixture is about 3 wt%.

* * * * *